United States Patent [19]

Hancock et al.

[11] Patent Number: 4,704,329

[45] Date of Patent: Nov. 3, 1987

[54] ANNEALED POLYESTER FILAMENTS AND A PROCESS FOR MAKING THEM

[75] Inventors: Jack A. Hancock, Franklin, Tenn.; Walter D. Johnson, Midlothian, Va.; Alan D. Kennedy, Kinston, N.C.

[73] Assignee: E. I. Du Pont de Nemours and Company, Wilmington, Del.

[21] Appl. No.: 942,714

[22] Filed: Dec. 17, 1986

Related U.S. Application Data

[60] Division of Ser. No. 590,291, Mar. 16, 1984, Pat. No. 4,639,347, and a continuation-in-part of Ser. No. 491,267, May 4, 1983, abandoned.

[51] Int. Cl.[4] ..... D02G 3/00

[52] U.S. Cl. ..... 428/369; 428/362

[58] Field of Search ..... 428/364, 369, 362, 371; 264/291

[56] References Cited

U.S. PATENT DOCUMENTS

| | | | |
|---|---|---|---|
| 2,604,689 | 7/1952 | Hebeler | 428/369 |
| 2,708,843 | 5/1955 | Gibson et al. . | |
| 3,044,250 | 1/1962 | Hebeler . | |
| 3,107,140 | 10/1963 | Kurzke et al. . | |
| 3,240,037 | 3/1966 | Bittle et al. . | |
| 3,452,132 | 6/1969 | Pitzl . | |
| 3,527,862 | 9/1970 | Shimosako et al. . | |
| 3,564,835 | 2/1971 | Keefe, Jr. et al. . | |
| 3,651,198 | 3/1972 | Mitsuishi et al. . | |
| 3,664,114 | 5/1972 | Ammons et al. . | |
| 3,667,094 | 6/1972 | Yazawa . | |
| 3,687,607 | 8/1972 | Yazawa . | |
| 3,739,056 | 6/1973 | Evans et al. . | |
| 3,816,486 | 6/1974 | Vail . | |
| 3,918,111 | 11/1975 | Dunn . | |
| 4,096,222 | 6/1978 | Bosley | 428/369 |
| 4,112,668 | 9/1978 | Spiller . | |
| 4,134,882 | 1/1979 | Frankfort et al. . | |
| 4,296,058 | 10/1981 | Chen et al. . | |

FOREIGN PATENT DOCUMENTS

| | | | |
|---|---|---|---|
| 735171 | 8/1955 | United Kingdom . | |
| 971878 | 10/1964 | United Kingdom . | |
| 1012461 | 12/1965 | United Kingdom . | |
| 1369851 | 10/1974 | United Kingdom | 428/369 |

OTHER PUBLICATIONS

*Research Disclosure* No. 13426 (Jun. 1975).

*Khimicheskie Volokna* No. 6, pp. 11–17, Nov.–Dec. 1981 (English translation).

*Zeitschrift fur die gesamtex Textil Industrie,* 65, 124–129 (1963), No. 2.

*Primary Examiner*—Lorraine T. Kendell

[57] ABSTRACT

A process for annealing drawn polyester filaments with saturated steam of at least about 150 psig provides products with a novel fine structure that results in an improved balance of strength, dyeability, shrinkage, crimpability and trimer in the product.

16 Claims, 5 Drawing Figures

ANNEALED POLYESTER FILAMENTS AND A PROCESS FOR MAKING THEM

TECHNICAL FIELD

This invention relates to a process for annealing drawn polyester filaments which provides products having a novel fine structure and improved balance of filament properties including dyeability, strength, dimensional heat stability, crimp, and low surface cyclic trimer. More particularly it relates to a process for annealing drawn polyester filaments while under restraint prior to being crimped and improved products which result therefrom.

BACKGROUND ART

Various methods for modifying the tensile, dimensional heat stability (residual shrinkage), and dyeability characteristics of drawn crystalline filaments of poly(ethylene terephthalate) are known which involve heating at a high temperature while maintaining the filaments under a controlled tension or length. For instance, British Patent Specification No. 735,171 to ICI discloses that the dyeability of yarns of poly(ethylene terephthalate) can be enhanced and shrinkage decreased by a heat treatment at temperatures on the order of 210°-230° C. while the yarn may or may not be allowed to shrink. U.S. Pat. No. 3,044,250 to Hebeler discloses a process for heating drawn filaments under drawing tension to improve their load-bearing properties relative to those of certain natural fibers and to improve their resistance to shrinking.

U.S. Pat. No. 3,816,486 to Vail discloses a two-stage drawing process for poly(ethylene terephthalate) filaments which can be followed by relaxation or annealing. Disclosed annealing temperatures range from 180°-240° C. Art such as this generally does not recognize any criticality associated with the manner for heating the filaments with regard to the resulting annealed filament properties. The presently preferred heating method for annealing drawn filaments in commercial polyester staple production is the use of heated metal rolls.

U.S. Pat. No. 3,452,132 to Pitzl discloses a process for simultaneously drawing and annealing polyester textile yarn wherein steam is jetted on the filaments in an enclosure with sufficient velocity to open the bundle and to raise the temperature of the filaments substantially instantaneously to at least above their second order transition temperature and thereby initiate drawing with simultaneous annealing. Steam at superatmospheric pressure is used as the fluid for the high velocity jet because of the effectiveness of the condensing steam as a heat transfer agent. The steam pressure is said not to be critical and no benefits are indicated for increasing the yarn temperature to above about 180° C. Such a process is not compatible for drawing and annealing large bundles of filaments such as employed for tows in the manufacture of polyester staple.

Recent advances in the synthetic staple fiber industry, such as open end spinning and higher speed looms for weaving, have created an increased demand for stronger staple fibers, but without compromising other properties such as dyeability and especially a low residual shrinkage which is the main reason for subjecting polyester filamentary tows to annealing process.

The combined objectives of high dyeability and high tensile properties remain somewhat irreconcilable in commercial hot-roll-annealing processes. An increase in one of these properties generally must come about through some compromise in the other. Similarly opposed interactions are also found when attempting to optimize properties such as low shrinkage, crimpability, and a low amount of surface cyclic trimer. Consequently, considerable incentive remains for discovering a commercially feasible process which can provide an overall better combination of such properties, i.e., one which involves less sacrifice in one or more individual properties to improve another.

An object of this invention is a process for annealing a tow of drawn filaments of poly(ethylene terephthalate) to provide an improved balance of filament properties including strength, dyeability, and shrinkage, and/or crimpability, and/or low surface cyclic trimer deposits. Another object is the improved products made thereby. Still another object of the invention is annealed crimped filaments of poly(ethylene terephthalate) having a novel unexpected combination of fine structure and improved filament properties.

These and other objects are provided by this invention.

DISCLOSURE OF THE INVENTION

We have discovered that saturated steam maintained at a pressure of at least about 150 psig can be used to anneal drawn filaments of poly(ethylene terephthalate) while under tension and prior to being crimped with unexpectedly beneficial results. As compared to comparably annealed crimped filaments prepared by hot roll annealing to similar levels of crystallinity and of shrinkage, the steam-annealed crimped filaments have been found to have a superior overall balance of properties which is usually accompanied by an unexpectedly different fine structure.

In the claims herein, and throughout much of the description, the term crimped filament is used generically to embrace not only continuous filaments, generally in the form of a tow, but also staple fiber, and products thereof. It is, however, generally easier to measure the parameters mentioned herein for continuous filaments, rather than for staple fiber.

Accordingly, this invention provides a process for manufacturing crimped, annealed filaments of poly(ethylene terephthalate) comprising advancing a tow of the filaments, which have been substantially fully drawn, through a pressurized zone of steam maintained at a pressure of at least about 150 psig for at least about 0.2 sec., and preferably for a time sufficient to heat substantially all of said filaments up to at least the steam saturation temperature corresponding to the steam pressure, while controlling filament length within the range of from about 5% extension to 10% retraction, withdrawing the tow of filaments from the zone into ambient atmospheric pressure whereupon they become rapidly cooled by vaporization of water to a temperature of about 100° C. or less while still under said controlled length, optionally further cooling as needed for proper crimping, crimping the cooled filaments, and then drying and relaxing the crimped filaments at a temperature of less than about 125° C., preferably less than 110° C.

After being cooled, the annealed filaments of this invention can be crimped in a conventional manner as in a stuffer-box crimper, as taught for example in U.S. Pat. No. 2,311,178 to Hitt, and then dried and relaxed at a temperature of less than about 125° C., since too high a temperature can destroy the benefits of the invention.

The filaments of this invention consist essentially of poly(ethylene terephthalate), that is polymer in which at least about 93% (by weight as used herein) of the repeating radicals consist of the dioxyethylene and terephthaloyl radicals. The remaining radicals, if any, can consist of ionic or neutral (free of ionic dye sites) comonomer radicals including radicals such as 5-sodium-sulfoisophthaloyl, dioxydiethylene ether, i.e., the derivative of diethylene glycol (DEG), glutaryl, such as derived from dimethyl glutarate (DMG), and the derivative of poly(ethylene oxide), such as PEO having a molecular weight of 600.

Other remaining radicals can also include those from (including their mixtures) 4–9 carbon straight-chain aliphatic diacids, especially glutaryl and adipyl, and of glycols including diethylene, triethylene and tetraethylene glycol, of 400–4000 molecular weight poly(ethylene glycol), tetramethylene and hexamethylene glycol, poly(butylene glycol) of 400–4000 molecular weight, and copolyethers of ethylene/propylene and ethylene/-butylene glycols of 400–4000 molecular weight.

Up to a certain amount of radicals with ionic dye sites, such as 5-sodium-sulfoisophthaloyl can be included. Although all the novel filaments of the invention are characterized by an overall balance of properties that is superior, i.e. improved over comparable hot rolled filaments, the degree and nature of this improvement, that is achieved by the steam-annealing process, varies depending upon the chemical constitution of the particular polyester involved. For textile uses where the relative viscosity is less than 25 and high tensile properties are desired, the improved filaments have a $T_7$ of at least about 1.5 gpd, a $T+T_7$ of at least about 7 and generally less than about 10 gpd, along with a dry heat shrinkage (196° C.) of less than 10%. Such filaments of the invention have a dyeability/orientation balance characterized by a "D" number of less than about 3.8 and greater than about 1.8 and a trimer "T" number that is preferably less than about 20. "D" number and trimer "T" number are as defined hereinafter and are derived from conventionally measured properties.

Preferred filament products of the invention can be grouped according to their intended use. Where strength is of primary concern the filaments are of a polymer containing at least 97% by weight of dioxyethylene and terephthaloyl radicals. Any remaining radicals are preferably selected from the group consisting of glutaryl, dioxy-poly(ethylene oxide) and dioxydiethyleneoxide. A small amount of ionic radical (up to about 0.3% 5-sodium-sulfoisophthalate) may be optionally present.

A preferred group of strong filaments is of polymers having at least 97% dioxyethylene and terephthaloyl radicals, substantially free of ionic dye sites, which in addition to the above balance of properties have a crystalline fine structure within the area HIJK in FIG. 2, or in areas LMNOP or NOPQR of FIG. 3.

When ease of dyeability with disperse dyestuffs is of primary concern, but good tensile properties and low shrinkage remain important, the filaments are of a polymer containing at least about 3% and not more than about 7% by weight of neutral (i.e., substantially free of ionic dye site) organic polyester radicals, particularly those selected from the group consisting of (or derived from) diethylene glycol, glutarate, adipate, and poly-(ethylene oxides) having a molecular weight of less than about 4000. Filaments of such copolymers of the invention have the improved balance of properties as defined by a $T_7$ of at least about 1.1, a $T+T_7$ of at least about 5 and preferably less than about 7 gpd, a dry heat shrinkage (at 196° C.) of less than 10%, a "D" number of less than 3.8 and greater than about 1.8, a trimer "T" number preferably of less than about 20 and dye rate (RDDR) of at least 0.12. Such copolymer filaments are preferably annealed while allowing a retraction in filament length (difference in feed and puller roll speeds) within the range of about 3 to 10%. Such filaments include ones having a superior combination of pilling resistance, ease of dyeability, tensile properties and heat stability relative to present commercial copolymer filaments.

Improved ionically-modified cationically dyeable filaments of the invention contain at least 93% dioxyethylene and terephthaloyl radicals, at least 1.3% 5-sodium-sulfoisophthaloyl radicals and from 0 to about 4% (including DEG impurity) of other neutral radicals as defined above. Such filaments have a $T_7$ of at least about 1.2 gpd, a $T+T_7$ of at least about 5 gpd and "D" and trimer "T" numbers as for the above polymers.

Preferred 93–97% copolymers and ionic terpolymers have a crystalline fine structure within the area STUV of FIG. 4.

DETAILED DISCLOSURE OF INVENTION

Figure 1:
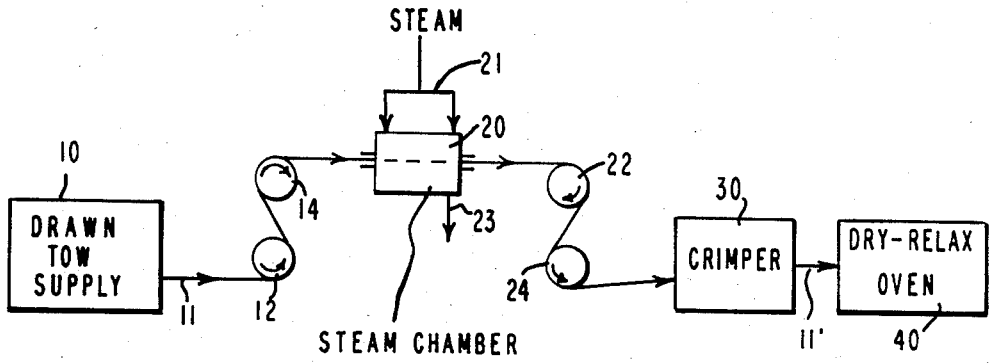
FIG. 1 schematically shows an apparatus suitable for and an anneal/crimp process of the invention.

This invention can provide filaments with unexpectedly superior tensile-dye-shrinkage properties, and which usually are combined with improved crimpability and lower surface cyclic trimer content.

The various parameters used herein, and their methods of measurement, are described in the following section. As indicated, it is generally easier to measure these parameters for continuous filaments, rather than for the resulting staple fiber.

Since commercial tows are often extremely large and contain very large numbers of fine filaments, variations between individual filaments and along the same filament inevitably occur, so any property measured on a small segment of a single filament can be misleading. For this reason, it is common commercial practice to make replications, i.e. repeated measurements on different filaments at different locations, to obtain a truer picture of the actual overall properties of filaments in any tow or of staple fiber or yarns therefrom. This should be remembered when considering the properties listed in the Examples, which were not the results of the large numbers of measurements that are characteristic of commercial practice. Thus, scrutiny of small differences between properties in the Examples may not reveal any significant effect in the sense that a difference in process operation was necessarily responsible for this particular difference in properties. We have, however, found that a significant increase in the saturated steam pressure into the pressure range that is according to the process of invention does improve the balance of properties of the resulting filaments, as shown in the comparative tests in the Examples. This is particularly true of the residual shrinkage obtained under otherwise comparable conditions. Thus, although individual shrinkage measurements may vary within a tow by two or more % on either side of the mean shrinkage, we have found that the mean shrinkage is significantly reduced as the saturated steam pressure is raised, e.g., from 120 psig to 150 psig. One individual measurement, however, as compared with another individual measurement, may not truly reflect the improvement in the mean values for the tows, as a whole. As the pressure is increased above 150 psig within the pressure range considered, since the mean shrinkage is reduced, other conditions being comparable, it becomes increasingly predictable that any shrinkage measurement will be in the most particularly desired range of 3 to 6%. As indicated elsewhere, depending on the chemical composition of the polyester, there may be a significant improvement in a particular property (the mean value), or a gradual improvement, as the pressure increases above 150 psig. Thus, the dyeability of some copolymers can be measurably improved, as shown in some of the Examples, whereas the dyeability of a homopolymer is not generally improved to the same extent.

Crimp Index and Denier Per Filament (DPF)

The crimped tow is straightened by application of about 0.1 gpd load and 0.5 gm clips 66.6 cm apart are attached to the extended tow. The tow is then cut 11.2 cm beyond each clip to give a sample of 90 cm extended length. The sample is suspended vertically, hanging freely from one of the clips to allow retraction to crimped length. After about 30 seconds, clip-to-clip distance is measured.

$$\text{Crimp index} = \frac{(66.6 - L_c)}{66.6} \times 100$$

where $L_c$ is clip-to-clip distance in the free-hanging state. Tow denier is calculated from weight of the 90 cm extended length sample. Average denier per filament is calculated from tow denier and the number of filaments in the tow.

Tensile Properties (T and $T_7$)

Tenacity at break elongation (T), and tenacity at 7% elongation ($T_7$) are determined from the stress-strain curve in a conventional manner using an "Instron" machine with a sample length of 10 inches (25 cm) and a rate of sample elongation of 60% per minute, at about 75° F. (24° C.)/65% RH. They are given throughout in gpd units.

FLEX LIFE

Flex life is measured by repeatedly bending single filaments, each tensioned to 0.3 gpd, through an angle of 180° over a wire of diameter 0.001 inch (0.025 mm). If the denier exceeds 5 dpf, the diameter should be 0.003 inch (0.075 mm). Twenty-two filaments are flexed simultaneously. Flex life is defined as number of cycles at the time the eleventh filament fails. This test is repeated, i.e., at least two bundles of filaments are tested, and the average number of cycles is taken as the flex life.

DHS—Dry Heat Shrinkage (196° C.)

Residual shrinkage is preferably and most accurately measured on uncut, crimped dried tow. The ends of a bundle of filaments of about 250 denier are tied to form a loop about 30 cm long. A load of about 0.1 gpd is applied to straighten crimp and loop length is determined to the nearest mm. The loop is coiled and freely suspended with no tension in a 196° C. forced air oven for 30 minutes. After cooling, length is remeasured as before.

$$DHS(196^\circ\text{ C.}) = \frac{(L - F)}{L} \times 100\%$$

where L and F are initial and final loop lengths, respectively.

With cut staple fiber, a single fiber or bundle of about 25 fibers is mounted between a fixed clamp and a moveable clamp attached to a Vernier scale. Sufficient tension is applied to straighten crimp and extended length is measured. The moveable clamp is adjusted to release tension and allow fibers to shrink freely. The assembly is transferred to a 196° C. forced air oven for 30 minutes. After cooling, extended fiber length is remeasured and shrinkage calculated as above.

Care to avoid cold drawing of the filaments is essential.

Boil-Off Shrinkage (BOS)

Boil-off-shrinkage (BOS) is measured as in Piazza and Reese (U.S. Pat. No. 3,772,872).

Density

See the method of Piazza and Reese (U.S. Pat. No. 3,772,872) Column 3 or ASTM D1505-63T.

Percent Crystallinity

Density is the preferred basis for calculating percent crystallinity for homopolymers. After correcting for any delusterant content, the percent crystallinity is calculated on the basis of an amorphous density of 1.335 gm/cc and a crystalline density of 1.455 gm/cc for 100% homopolymers. However, as the amount of modifier increases, the amorphous and crystalline densities of copolymers can differ significantly from these values conventionally used for homopolymers, so calculation of percent crystallinity on this basis can be misleading. This is especially true when the copolymer contains more than 3% of modifier, but depends on the particular modifier. Percent crystallinity of such copolymers should be calculated from the Crystallinity Index (CI) using the equation:

$$\text{Percent Crystallinity} = 0.676 \times \text{CI}$$

Because large tows can show significant variations in properties, especially from filament to filament, replication of CI measurement is particularly desirable, to avoid obtaining a misleading result.

Melting Point

Melting point is defined as the temperature of the melting endotherm peak measured in a $N_2$ atmosphere using a Du Pont 1090 Thermal Analyzer with a Du Pont 1910 scanning calorimeter attachment. Sample size was 5±0.2 mg and scanning rate was 20° C. per minute.

LPS—Long-Period Spacing

The meridional small-angle X-ray long-period peak was measured using a Kratky Small-Angle X-Ray Camera (made by Anton Paar K. G., Graz-Strassgang, Austria, and sold by Siemens Corp., Iselin, N.J.). The radiation was CuKα (copper K-alpha) emitted by an X-ray tube (Siemens AG Cu 4SK-T) having a 2.5×7 mm focal spot and especially designed to be used with the Kratky Camera. The radiation was filtered by a 0.7 mil (18 microns) Ni foil to remove CuKβ radiation and detected by a NaI(Tl) scintillation counter employing single-channel pulse-height-analysis set to pass 90% of the CuKα radiation symmetrically. The pulse-height analysis removes the major portion of the continuous radiation emitted by the X-ray tube.

The specimens were prepared by winding uncut, crimped tow on a 2.5 cm square frame with an opening sufficient to pass the X-ray beam. The tow was wound with sufficient tension to yield a uniform thickness of essentially parallel fibers. If the measurement is to be on cut staple fibers, these can be spun into a yarn to maximize fiber parallelization. Care must be taken in yarn preparation to avoid mechanical damage such as cold draw which might change the fiber structure. When working with staple fibers, appropriate control samples, tested both as uncut tow and as a spun staple yarn should be run to determine any correction factors needed to normalize spun yarn data to that of uncut tow.

Specimen thickness after winding was sufficient that transmission of CuKα radiation approached $e^{-1}=0.368$. This ensures that diffracted intensity will be near the maximum obtainable. About 1 gm of polyester sample will typically give the desired transmission on a 2.5 cm square sample holder.

The wound specimen is mounted in the Kratky camera so that the fibers are vertical (the fiber axis is coincident with the diffraction vector, which bisects the incident and the diffracted beams). The Kratky camera scans in a vertical plane about the horizontal axis described by the intersection of the X-ray beam and the sample.

With the X-ray tube operating at 45 KV and 20 ma and with a beam-defining slit of 120 μm, the sample is scanned between 0.1° and 2.0° 2θ in 0.025° steps. Data are digitized for computer analysis and a smoothed curve is constructed using a running fit to a second order polynomial. The instrument background is removed by subtracting, point-by-point, a background scan obtained with no sample multiplied by the observed transmission, T. A correction factor, C, is determined from the transmission, T, as:

$$C = \frac{1.0}{eT\ln(T)}$$

($e = 2.71828$, $\ln(T)$ is the logarithm of $T$ to the base $e$)

The data are then corrected by multiplying each point by C, which corrects for the amount of sample in the X-ray beam and puts data from every sample on an equivalent basis. If experiments cover an extended period of time, one sample should be retained as a reference and scanned as necessary to monitor any drift in instrumental response.

Long-period spacing, d, is calculated using Bragg's Law, $d=\lambda/2 \sin \theta$, where $\theta$ is the angular position of the meridional long-period peak and λ is the wave length of incident radiation (1.54 Å).

Measured long-period spacing sometimes depends on the experimental method. For example, a photographic-film-based procedure can give a slightly different result from the goniometer procedure described above.

Other methods can be calibrated for comparison with the above method by preparing a standard sample as follows.

Spun filaments are prepared from 21 RV polyethylene terephthalate homopolymer containing about one weight percent or less of impurities such as diethylene glycol. Filaments are air quenched and spun at about 1500 ypm (1372 meters/min) to 4 dpf. The spun filaments are two-stage drawn in an aqueous environment in a process basically similar to that described by Vail (U.S. Pat. No. 3,816,486) and then annealed at constant length over heated rolls. Draw ratios may differ somewhat from Vail and are selected to ensure uniform draw in the first stage and a final tenacity of about 6.3 gpd. A second stage draw ratio of about 1.15 is suitable. Length retraction of 2 to 4% is allowed in the annealing. Annealing rolls are heated to first dry the filaments and then heat them to a temperature of 200° C. for about 1.5 seconds. Annealed filaments are water-quenched then stuffer box-crimped and dried in air under zero tension at 120° C. for 10 minutes. Filaments are spread into a thin ribbon on the anneal rolls for maximum filament to filament heat treatment uniformity. These filaments have an LPS of 120 Å when tested as described above.

ACS—Crystal Size

Apparent crystallite size (ACS) is measured as described by Blades (U.S. Pat. No. 3,869,429 Col. 12) with some modifications. High intensity X-ray source is a Phillips XRG-3100 with a long, fine focus copper tube. Diffraction is analyzed with a Phillips single axis goniometer equipped with a theta-compensating slit and a quartz monochromator set to exclude copper Kβ radiation. Diffracted radiation is collected in step scanning mode in 0.025° steps with a 1.5 second per step count time. The digital data so collected are analyzed by a computer and smoothed by a running fit to a second order polynomial. Crystalline polyethylene terephthalate filaments show a clear 010 diffraction peak with a maximum at about 18° and a minimum at about 20°. The computer is programmed to determine positions of the maximum and minimum from the second derivative of the polynomial, to define the base line as a straight line which begins at the minimum at about 20° and joins the diffractogram tangentially at 10° to 14°, to determine peak width at half height, to correct for the instrumental contribution to line broadening and to calculate ACS as described by Blades.

Crystallinity Index

Crystallinity Index (CI) is determined from the same diffractogram as ACS. The computer is programmed to define a straight base line which joins the diffractogram tangentially at about 11° and 34°. Crystallinity index is defined as $$\frac{A \times 100}{A - B}$$

where A is the intensity of the 18° 010 peak above this base line and B is the intensity of the 20° minimum above this base line.

CI is related to percent crystallinity. It was calibrated by preparing a standard series of hot roll annealed fibers ranging in densities from 1.3766 to 1.3916, after correction for $TiO_2$ content. Weight percent crystallinity was calculated conventionally assuming amorphous and crystalline densities of 1.335 and 1.455, respectively. Linear regression analysis showed weight percent crystallinity=0.676×CI, correlation coefficient was 0.97 and intercept a negligible 0.1.

Relative Viscosity (RV)

Relative Viscosity (RV) is the ratio of the viscosity of a 4.47 weight on weight percent solution of the polymer in hexafluoroisopropanol containing 100 ppm sulfuric acid to the viscosity of the solvent at 25° C.

RDDR

DDR (disperse dye rate) is measured as described by Frankfort and Knox (U.S. Pat. No. 4,195,051, Col. 13). RDDR is calculated from DDR by normalizing to the surface-to-volume ratio of a 1.50 dpf round fiber.

$$RDDR = DDR(DPF/1.50)^{\frac{1}{2}}$$

If the fiber is non-round, additional correction is needed to compensate for its increased surface area. Correction may also be made for denier increase caused by shrinkage in the dye bath (i.e., boil-off shrinkage, or BOS). However, fibers of the invention have low BOS and such correction is usually negligible.

"D" Number $$\text{"}D\text{"} = \frac{e^{0.04(T+T7)} \times (T + T_7)^{-1.06} \times e^{0.25(WMOD)}}{RDDR}$$

where RDDR, WMOD, T and $T_7$ are as defined herein.

SCT—Surface Cyclic Trimer (Content)

0.5 gm of crimped, dried fibers or tow is accurately weighed and immersed in about 15 ml of spectrograde carbon tetrachloride at about 75° F. (24° C.) for about 5 minutes. The mixture is stirred periodically. The resulting trimer solution is separated from the fibers using a funnel and the fibers are then washed with about 5 ml additional carbon tetrachloride. Solution and washings are combined and made up to known volume. Trimer concentration is determined by conventional UV spectrophotometry based on absorbance at 2860 Å. Correction for interfering impurities, for example, finish ingredients with absorbance at 2860 Å, may be needed.

A calibrating standard is prepared by purifying a sample containing trimer by repeated recrystallization from methylene chloride to yield pure trimer melting at 325°-328° C.

"T" Number (Trimer)

$$\text{"T" number} = [SCT(\text{ppm}) + 1] \times e^{-0.2(T+T7)}$$

Trimer level increases with draw ratio and orientation. The word "Trimer" is used generically to cover any low molecular weight polymer on the surface of the filament.

Polymer Compositions

All polymer composition percentages in the Examples are based on analysis of the crimped filaments and refer to polymer components other than ethylene terephthalate units. For diacid comodifiers, unless otherwise specified, "composition" is defined as weight % of ethylene-diacid repeat units. For example, for filaments derived from dimethyl glutarate comonomer (DMG), the polymer composition is defined in terms of weight % ethylene glutarate. For dialcohol modifiers, the composition is specified as grams dialcohol formed by hydrolysis of 100 gm. of copolymer. Unless indicated otherwise, all the polymer compositions in the Examples contained 0.3% by weight of $TiO_2$, as delusterant.

WMOD

WMOD is the total weight % "foreign" radicals incorporated in the polymer chains. "Foreign" denotes chemical species other than dioxyethylene and terephthaloyl radicals. For example, for a glutarate copolymer, the foreign species is —CO—$(CH_2)_3$—CO—. The total weight % includes dioxydiethylene ether (DEG) links usually formed in the polymerization reaction.

MDR—PRUD—TDR

These terms are used in the Tables in the Examples and refer to the ratios of roll speeds.

MDR is the machine draw ratio used to make the substantially fully drawn filaments that are fed to the steam-annealing pressurized zone (steam chamber 20 in FIG. 1).

PRUD is the ratio of the speed of the puller roll (22), after the steam chamber, to the speed of the draw roll (14), before the steam chamber.

TDR is the total draw ratio, i.e. $TDR = PRUD \times MDR$.

The filaments used in the process of the invention may be drawn by any means known to those skilled in the art. A draw process substantially of the type described by Vail (U.S. Pat. No. 3,816,486) is suitable for the drawn filament supply. First and second stage draw ratios are selected based on polymer composition, spun orientation and desired final tensile properties. Single-stage processes are also suitable. For optimum dyeability, filaments should not be overdrawn. Excessive draw ratios yield no advantage in drawn filament tenacity compared to lower draw ratios. However, it has been found that dye rate is adversely affected when draw ratio is excessive. At any given level of spun orientation, optimum draw ratio depends on polymer composition and relative viscosity. It is known to those skilled in the art that some adjustment can be required to determine optimum draw ratio for any given combination of polymer type and spun orientation.

The drawn filament bundle is advanced to, enters and then leaves the steam chamber through orifices sized and designed to maintain the desired superatmospheric pressure inside the chamber. Filament bundle thickness and shape (e.g., round or ribbon) and chamber residence time are adjusted so that substantially all filaments reach the saturated steam temperature. For tow bundles of about 50,000 denier, circular orifices 0.125 inch (3.2 mm) in diameter and 1.25 inches (32 mm) long are satisfactory. Residence times can be from about 0.2 to about 1 second. A low residence time, such as 0.2 to 0.6 seconds may be preferred when it is desired to minimize surface trimer content, otherwise higher residence times may be preferred.

Steam can be fed into the chamber substantially uniformly along its length, as from orifices along a manifold along the inside top of the chamber, thus avoiding impingement of the incoming steam directly onto the filaments as is required in steam-jet drawing. The chamber is fitted with a condensate outlet. The steam supply system is sized and fitted with control valves and gauges as appropriate to maintain and measure pressure inside the chamber. As the tow of filaments leaves the chamber, it is rapidly cooled by evaporation of water to about 100° C., or less, at normal atmospheric pressure.

The tow is then forwarded to a crimper. It is well known that fiber tensile properties, particularly $T_7$, and crimp frequency and crimp amplitude depend both on temperature of the tow entering the crimper and on temperature inside the crimper. Excessive temperatures can reduce $T_7$ and give undesirably high crimp frequency. Additional cooling of the tow before the crimper may be needed and temperature inside the crimper must be carefully controlled for optimum results. A suitable lubricating finish is generally applied prior to crimping.

In prior commercial hot-roll annealing processes, appreciable energy and time is required to remove residual water from the drawn bundle before annealing occurs. It is a particular advantage of this invention that any such residual water need not be removed.

The steam pressure in the process of this invention preferably should not exceed about 320 psig (2300 kPa) for the higher melting polymers, corresponding to a saturation temperature of about 220° C. Higher temperatures adversely affect filament properties and create operability problems because of proximity to the filament softening temperature. Copolymers which have a lower softening temperature require a correspondingly lower maximum operating temperature, i.e., a lower steam pressure. It is preferred that the maximum temperature that the filaments reach be that of the condensation temperature corresponding to the steam pressure in the steaming zone. Other than to control flooding, superheating is unnecessary.

To achieve optimum filament dye properties a small amount of let down (retraction), especially with copolymers, of from 3 to 10% in the annealing zone is required. Allowance of greater retractions can lead to operability problems and poorer tensile properties.

Although it is not fully understood why the steam-annealed filaments prepared by this invention have such an improved combination of properties, it is theorized that it can be attributed to a novel fine structure in which high amorphous orientation and high amorphous chain mobility occur simultaneously. Consistent with this belief, it has been found that the better steam-annealed fibers of this invention have a higher long-period spacing (LPS—the average distance between adjacent crystal centers along the fiber axis) as determined by X-ray, relative to filaments having similar tensile properties annealed under comparable conditions but with other heating methods such as hot rolls. A high LPS means that anchor points for polymer chains in the amorphous region are widely separated. This perhaps allows for greater amorphous mobility. For example, whereas the LPS is usually less than about 120 Å for highly oriented fibers annealed commercially with heated rolls, fibers annealed with saturated steam to similar levels of crystallinity and of shrinkage generally have an LPS of 125–150 Å.

Highly crystalline, low shrinkage fibers are usually difficult to crimp. This possibly is because some shrinkage in the crimper is needed to develop crimp amplitude. Steam-annealed fibers appear surprising in that, even after crimping, they have a measurable level of low temperature shrinkage, i.e., shrinkage in boiling water (BOS), despite high crystallinity, as indicated by density and low dry shrinkage at 196° C. Both the easy crimpability and the measurable BOS possibly result from the same unusual fine structure feature. It is hypothesized that the intercrystalline regions are relatively free of microcrystals, very small local aggregations of chain segments in a crystalline configuration. Microcrystals would inhibit motion of amorphous chain segments at low temperatures, thereby reducing low temperature shrinkage and making crimping more difficult. However, they would melt at relatively low temperatures and, therefore, not contribute to length stability of high temperatures. Because they reduce amorphous chain mobility, microcrystals could also reduce dyeability.

The fine structure of the filaments of the invention and the associated advantages thereof can be most readily detected by measurement of dye rate and filament orientation. Dye rate reflects both mobility and orientation, whereas the sum of the tenacity and $T_7$, i.e., $T+T_7$, directly reflects orientation alone. By examining these and other structure-sensitive properties, the effects of the invention can be identified.

The fibers of this invention have an improved combination of properties including improved strength, low dry heat shrinkage to maximize fabric yield after heat-setting, and a high dye rate to reduce dyeing costs. Some filaments of this invention further reflect their improved properties through superior crimp and a lower concentration of surface cyclic trimer. The latter provides improved processability and fewer deposits during processing into yarn.

The improved filaments of the invention can be described by their position in a three-dimensional space described by three coordinates relating to amorphous orientation (namely $T+T_7$), amorphous chain mobility (namely RDDR) and weight percent copolymer modifier (i.e. WMOD). This is why we have used herein the "D" number, which is defined above, as a simple function of the above three parameters, and which is less than about 3.8 for strong, low-shrinkage annealed filaments of the invention.

Steam-annealing by this invention has a particularly unexpected effect on site-dye copolymers such as the cationically dyeable polyesters made by including in the polymer chain an aromatic acid monomer containing a sodium sulfonate group, such as 5-sodium-sulfoisophthalic acid. Whereas the uptake of reactive cationic dyes by such polymers in filaments usually depends upon the number of reactive sites in the fiber, it has been discovered that a terpolymer fiber of the invention containing 1.6 weight % of the site-reactive isophthalate plus a neutral dimethyl glutarate co-monomer gives a higher dye uptake than a conventional fiber containing about 3 weight % of the cationic dye site. This surprising effect can be used to either improve dyeability at an equal modifier level or to maintain dyeability at a reduced modifier level.

The response of dye rate to comonomer content with neutral comonomers also benefits from steam-annealing by this invention. A steam-annealed fiber containing 2.9% ethylene glutarate derived from dimethyl glutarate (DMG) was found to be fully equivalent in dye rate to a known fiber containing 5.7% ethylene glutarate, and to have substantially better tensile properties in addition. In general copolymers show similar improved development of crimp amplitude and reduced levels of surface cyclic trimer as obtained with homopolymers.

On average, the steam-annealed filaments of the invention have about a 1.5X higher dye rate than roll-annealed filaments made from the same base polymer and of similar orientation, crystallinity and shrinkage.

At equal $T+T_7$, steam-annealed homopolymer filaments have less surface cyclic trimer (SCT) than roll-annealed filaments of comparable shrinkage. The trimer level generally increases with draw ratio, i.e., orientation.

Filaments of this invention may be prepared from multifilament tows in textile deniers per filament (dpf), preferably less than 6.0 dpf, as well as in heavier carpet and industrial filament and yarn sizes. The filaments preferably are combined in the form of a heavy tow, such as is greater than about 30,000 denier, and especially greater than about 200,000 denier. The filaments are not restricted to any particular type of filament cross-section and include filaments of cruciform, trilobal, Y-shaped, ribbon, dog bone, scalloped-oval and other non-circular cross-sections, as well as round. The filaments may be used as crimped continuous filaments, yarns, or tows, or as staple fibers of any desired length, including conventional staple lengths of from about 0.75 to about 6 inches (about 20 to 150 mm).

The filaments are crimped to the desired degree depending upon their use. For conventional staple fiber applications the filaments preferably have a crimp index of at least about 20.

The invention is illustrated in the following Examples, which illustrate also the results of comparative workings, some without steam and some using saturated steam at pressures lower than about 150 psig, i.e., lower than about 1100 kPa, to demonstrate the different results that have been obtained. The actual pressures were measured. Because of variations in readings from different pressure gauges, and because extremely precise pressure readings have not generally seemed particularly significant with respect to differences in properties of the resulting filaments, the pressures in the Examples have been rounded to the nearest 5 psig. The high saturated steam pressures that are used according to the invention are believed to be important because they enable the filaments, which are generally present in extremely large numbers, to be heated efficiently and rapidly to the temperature of the saturated steam. So these temperatures, referred to as annealing temperatures in the Examples, have been calculated from Standard Tables, and are also referred to herein, because the precise temperature can be of critical importance. When these annealing temperatures are considered, rather than pressures, the improvements that can be obtained by raising the pressure of the saturated steam are with certain polymer compositions, very dramatic in terms of the amount the properties can be changed by a relatively small increase in temperature. For instance, comparing the results of Items 7 to 9 in Table 10, from Example 8, hereinafter, Item 9 shows a significantly improved shrinkage of 6% over Item 8 (10%), although the temperature of the saturated steam was only 5° higher (188° instead of 183°), whereas the difference in shrinkage between Items 7 and 8 is smaller (only 2%), despite a rise in temperature of 12°. It will be noted also that the LPS of Item 9 (126 Å) is significantly larger than those of Items 7 and 8 (114 and 115 Å).

EXAMPLE 1

This Example demonstrates superior filaments made by annealing with saturated steam at pressures of at least about 150 psig (above 1100 kPa).

The apparatus and process are as represented schematically in FIG. 1. Referring to FIG. 1, tow 11 of drawn filaments is supplied from source 10 by feed rolls 12, 14 aligned with the inlet of the steam chamber 20 and advanced through chamber 20 at a controlled length by adjustable-speed puller rolls 22, 24 aligned with the chamber outlet. The tow is then forwarded to crimper 30 and conventionally crimped. From there crimped tow 11' passes to dryer-relaxer oven 40 where the crimped filaments are conventionally dried in a relaxed state. Pressurized steam is supplied to chamber 20 via manifold 21. Condensed water is removed from chamber 20 by condensate outlet 23. Conventional steam control valves and gauges are not shown.

It will be understood from the description of the apparatus that the tension on the filaments during annealing is controlled by rolls outside the steam chamber, and all discussion herein of extension or retraction during annealing or, e.g., in the pressure zone should be understood in this sense. Depending on the particular design of apparatus, the temperature profile along the filaments may affect the location where the filaments tend to retract. So the annealing may take place in more than one step, with different extensions and/or retractions in these steps. Indeed more than one such annealing step may prove desirable in some instances.

Filaments of poly(ethylene terephthalate) homopolymer (0.5% diethylene glycol impurity) of about 21RV, and having 4.0 dpf were spun at 1500 ypm (1372 meters/min) and collected. The resulting tow of 31,500 filaments is drawn in two stages using a process substantially of the type as described in U.S. Pat. No. 3,816,486 (Vail) to a drawn dpf of about 1.5. The tow is passed from the last stage draw rolls through a pressurized steam chamber, while maintained under a controlled length, for 0.4 seconds, withdrawn into ambient atmospheric pressure, accompanied by rapid cooling to about 100° C. while still at said controlled length. The tow is then passed through a 70° C. water-spray with 0.3% finish and then steam-crimped in a conventional manner using a stuffer-box crimper. All crimped fibers were dried at substantially zero tension in a relaxer oven at 90° C. unless specified.

The pressurized steam annealing chamber is 15 inches (38 cm) long with an inside diameter of about 1.4 inches (3.6 cm). The tow entrance and exit orifices were 0.125 inch (3.2 mm) diameter and 1.25 inches (3.2 cm) long. Steam enters the chamber horizontally from orifices spaced along sides of a manifold along the inner top of the chamber.

Properties of filaments made under various conditions are shown in Table 1. As shown by Item 1, Table 1, reasonably high orientation fibers can be made by drawing conventionally and with no annealing after cooling the drawn filaments, with a fairly good combination of $T+T_7$ and dye rate (RDDR), but residual dry heat shrinkage (DHS) is unacceptably high, being greater than 10%. As shown by Items 2 and 3, Table 1, this shrinkage can be improved by drying the filaments at a higher temperature after crimping but this reduces orientation and dye rate. In contrast, the filaments annealed with saturated steam at a pressure of about 200 psig, however, Items 6, 7 and 8 of the invention, exhibit a good combination of a high orientation, a low shrinkage and good dye rates (50–70% superior to comparable hot-roll-annealed filaments, not shown in these Tables).

When another portion of Item 7, Table 1, was dried at 125° C. (instead of 90° C.) it had the following properties: DPF 1.45, T 6.6 gpd, $T_7$ 2.7 gpd, Elongation 14%, DHS (196° C.) 6%, SCT 180 ppm, density 1.401 gm/cc, RDDR 0.035, "D" number 4.4 and "T" number 28. When dried at 150° C. the properties were: DPF 1.47, T 6.6 gpd, $T_7$ 2.0 gpd, Elongation 16%, DHS 6%, SCT 565 ppm, density 1.397 gm/cc and RDDR 0.026, "D" number 6.3 and "T" number 101. These higher "D" and "T" numbers demonstrate why it is desirable to maintain the temperature lower during drying.

Two more sets of comparative data are shown in Table 2. The first set, items 9–11 compare the effects of raising steam pressure using process conditions that are otherwise similar to those in Items 1 and 6. Only the high steam pressure of 150 psig in item 11 gave the low shrinkage desired. The increase in LPS is very significant.

Items 13 to 15 show different drawing conditions, namely lower draw ratios and more letdown to give lower TDRs than in items 9 to 11. For item 15, when a high steam pressure (200 psig, 1480 kPa) was used, a desirably low shrinkage of 6% was obtained, whereas higher shrinkages were obtained for the other items using lower pressures. Although the shrinkage value of 9%, shown for item 13, is surprisingly low, it has been our experience that steam pressures of the order of 100 psig (about 800 kPa) do not generally give a good balance of properties, and this measurement may have been an aberration.

From Tables 1 and 2 it can be seen that these filaments of the invention annealed with saturated steam at pressures of at least 150 psig (above 1100 kPa) have high LPS values of 127 and 138. Table 2 also shows that these filaments of the invention crimp readily as reflected in high crimp index values, and have adequately low surface trimer.

For the homopolymers containing very little DEG, a high steam pressure of about 150 psig (1100 kPa) or even more is generally used to obtain the desirable low shrinkages, which are preferably not more than 8%. Although such low shrinkage can be obtained by other means, the low shrinkage has not previously been obtained with the desirable balance of properties, as disclosed herein. Similarly, for copolymers containing small amounts of nonionic modifiers, as in Table 10, hereinafter, the shrinkage is significantly affected by temperature.

However, for copolymers with ionic modifiers, such low shrinkage can be obtained at steam pressures below 150 psig (1100 kPa). Higher steam pressures give the advantage of substantial improvement in dyeability, and the shrinkage can be further improved significantly by increasing the pressure beyond 150 psig.

Essentially the same procedures were used to make the filaments in the following Examples varying the compositions of polymer, and the process conditions as discussed and shown in the Tables. Spinning speeds of 1900 ypm (1737 meters/min) were used in Examples 2, 3, 5 and 6.

Many of the samples with WMOD exceeding 3.0% were drawn via using single stage equipment similar to that described by Vail (U.S. Pat. No. 3,816,486) but with all the draw taken in the second stage spray zone. Temperature in the draw zone was adjusted for best operability and ranged from 90° to 98° C. It is known to those skilled in the art that experimentation is frequently needed to achieve good draw operability with copolymers.

At least a small amount of letdown (PRUD), about 1 to 2%, in the steam annealing zone is generally desired for optimum properties. A dry heat shrinkage of less than 8% is preferred for filaments to be used in woven fabrics.

EXAMPLE 2

This Example demonstrates filaments of cationically-dyeable copolymers of poly(ethylene terephthalate) of RV about 17 (items 1-1 to 1-6) and about 18 (items 1-7 and 1-8), and containing 0.2% $TiO_2$, in Table 3.

Steam-annealed Item 1-5 has superior tensile properties and dye rate as compared with unannealed Item 1-1 filament. (It was found to have a 70% higher dye rate than hot-roll annealed filaments of similar orientation, not shown). Particularly good dye rate is obtained if the fiber is allowed to retract about 10% in the steam annealing step. For instance, Item 1-6 was allowed to retract 12%, and is about equal to Item 1-1 in orientation but has a 1.5-2X higher dye rate.

Best filament properties require annealing pressures of at least about 150 psig (1100 kPa). Item 1-4 steam-annealed at 95 psig (760 kPa) is significantly worse than Item 1-5, both in residual shrinkage and in dye rate.

Steam-annealing of the invention can allow substantial reduction in copolymer content with no sacrifice in dye rate. For example compare Items 1-8 and 1-1.

EXAMPLE 3

This Example demonstrates filaments of RV of about 20 from poly(ethylene terephthalate) containing glutaryl radicals from dimethyl glutarate (DMG) comonomer and 0.2% $TiO_2$, in Table 4.

Steam-annealed filament 2-8 is superior to unannealed filament 2-1 in tensiles and in dye rate. Item 2-4 steam annealed at a pressure of about 95 psig (760 kPa) has an unacceptably high dry heat shrinkage of 12 and low LPS demonstrating again the improvement achieved by using higher annealing pressures.

EXAMPLE 4

This Example compares the effects of saturated steam-annealing at 198° C. (200 psig, 1480 kPa) of a cationically dyeable terpolymer of poly(ethylene terephthalate) made from the dimethyl esters of glutaric acid and 5-sodium-sulfoisophthalic acids and containing DEG impurity with a commercial fiber. The polymer has an RV of about 17 and 5.8 dpf filaments are spun at 1500 ypm (1372 meters/min) and drawn 2.8X using a puller roll underdrive of 0.92 for a total draw ratio of 2.6. The filaments are annealed with saturated steam at 200 psig, crimped in a stuffer-box crimper and dried at 80° C. in a relaxed condition. The filaments have a crimp index of 29. The crimped rope is cut to 1.5 inch (38 mm) staple and spun into yarns which are knitted into fabric. The fabric is dyed without carrier at the boil with disperse and with cationic dyes and compared with dyed 2.25 dpf commercial cationically dyeable polyester staple (Type 64 made by E. I. du Pont de Nemours and Company). Filament tensile properties and dye results are shown in Table 5. It is seen that the dye rate and the dye bath exhaust by the steam-annealed filaments are significantly superior to those of the commercial fiber. It is surprising that higher exhaust is obtained, even with cationic dyes, for the test item of the invention which contained 40% less reactive dye sites than the commercial fiber.

EXAMPLE 5

This Example demonstrates in Table 6 filaments made from various copolymers of poly(ethylene terephthalate), including as comonomer components diethylene glycol (DEG), and combinations of sodium-sulfoisophthalate with DMG. DEG was added to the monomer feed for Items 3-1 and 3-3; it was an impurity in Items 3-4 and 3-6. Annealing with saturated steam at pressures of 150 psig (1100 kPa) or more provides a better balance of orientation and dyeability than that of unannealed relaxed fibers or of hot-roll-annealed fibers (not shown in Table). Again steam-annealed filaments of the invention were found to have a higher crimp index than their hot-roll-annealed analogs (not shown in Table).

A comparison of steam-annealed Item 3-3 with Item 3-1 clearly reflects the advantages of the invention in producing filaments having an improved crimp index, low surface cyclic trimer and high dyeability at otherwise relatively comparable orientation and shrinkage levels.

EXAMPLE 6

This Example demonstrates in Table 7 annealing according to the invention using different annealer retractions on 3.2 dpf filaments of RV about 21 of poly(ethylene terephthalate)homopolymer (1% DEG impurity) spun at 1900 ypm. All the items M, D and R are seen to have a high dye rate, high crimp index and low cyclic trimer level.

EXAMPLE 7

This Example demonstrates copolymer filaments of this invention containing poly(ethylene oxide) of 600 molecular weight annealed with steam at 200 psig in Table 8.

EXAMPLE 8

This Example illustrates the properties and fine structure of steam-annealed fibers containing 97% by weight or more dioxyethylene and terephthaloyl radicals.

Table 9 gives properties of samples prepared from the homopolymer spun supply of Example 1, at several draw ratios, anneal retractions and anneal pressures. A representative crimped sample from this series had a melting point of 257.4° C. Item 6 was prepared at a pressure of only 110 psig (860 kPa).

Fine structure properties of some copolymers containing about 3% or less of modifier are in Table 10. DEG was added to the polyethylene glycol feed to prepare Table 10, Items 1 and 2. For all other items, the DEG was formed in the polymerization reaction.

Items 1 and 2 in Table 10 were samples of polyethylene terephthalate containing 2.35% DEG, spun at 1500 ypm (1372 meters/min) to filaments of 4.0 dpf, and of about 20 RV, which were drawn, annealed and crimped as described in Example 1. A representative crimped sample had a melting point of 249.6° C.

Items 3 to 6 were samples of polyethylene terephthalate containing 2.1% polyethylene oxide of 600 molecular weight, 1.0% DEG and 0.2% $TiO_2$ spun at 1900 ypm (1737 meters/min) to 3.36 dpf filaments, of about 22 RV, which were drawn, annealed and crimped as described in Example 1. A representative crimped sample had a melting point of 253.1° C.

Items 7 to 9 were samples of polyethylene terephthalate containing 3% ethylene glutarate (1.8% glutaryl radicals), 1.2% DEG and 0.2% $TiO_2$, spun to 3.2 dpf filaments, of about 20 RV, which were drawn, annealed and crimped as described in Example 1. A representative crimped fiber had a melting point of 246.5° C.

Figure 2:
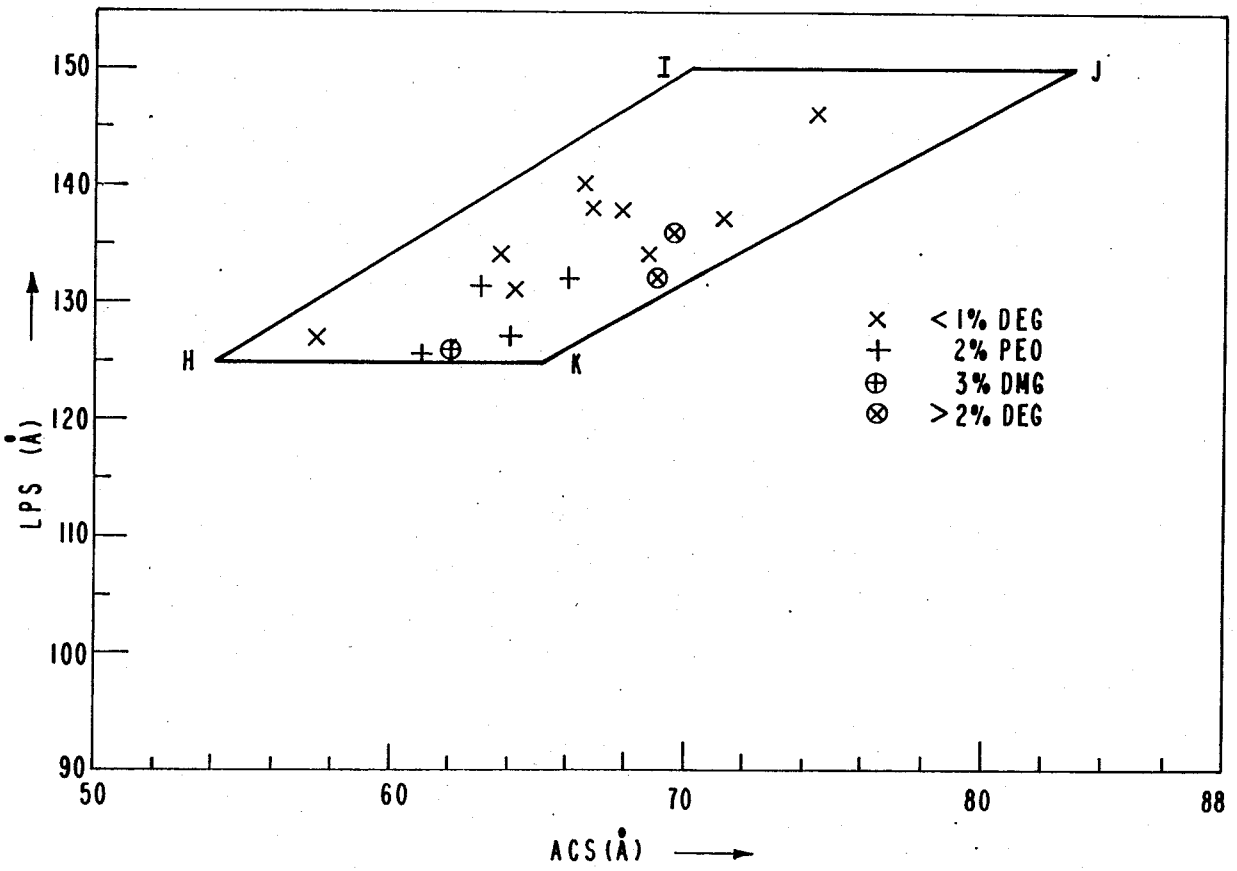
FIGS. 2–4 are graphs showing X-ray fine structure details of Long Period Spacing, Apparent Crystallite Size and Percent Crystallinity for steam-annealed filaments of the invention.

FIG. 2 shows relationship between LPS and ACS for items of the invention from Tables 1, 2, 7, 9 and 10. Items in the Tables with ACS and LPS falling below the links HK and KJ were made at anneal temperatures below 185° C. (below 150 psig) and have high residual shrinkages. Further, although high shrinkage fibers usually have relatively high dye rates, those falling outside the area HIJK have the same or a poorer balance of orientation and dye rate than those within the area. This is evident by comparing "D" numbers in the tables. Table 10, Item 2 is an example of an "overdrawn" filament. Despite a favorable crystalline fine structure, its "D" number is high. The drawing conditions were MDR=3.09, PRUD=0.98 and TDR=3.03. This item 2 was prepared in the course of an empirical determination of optimum drawing conditions for that polymer.

Figure 3:
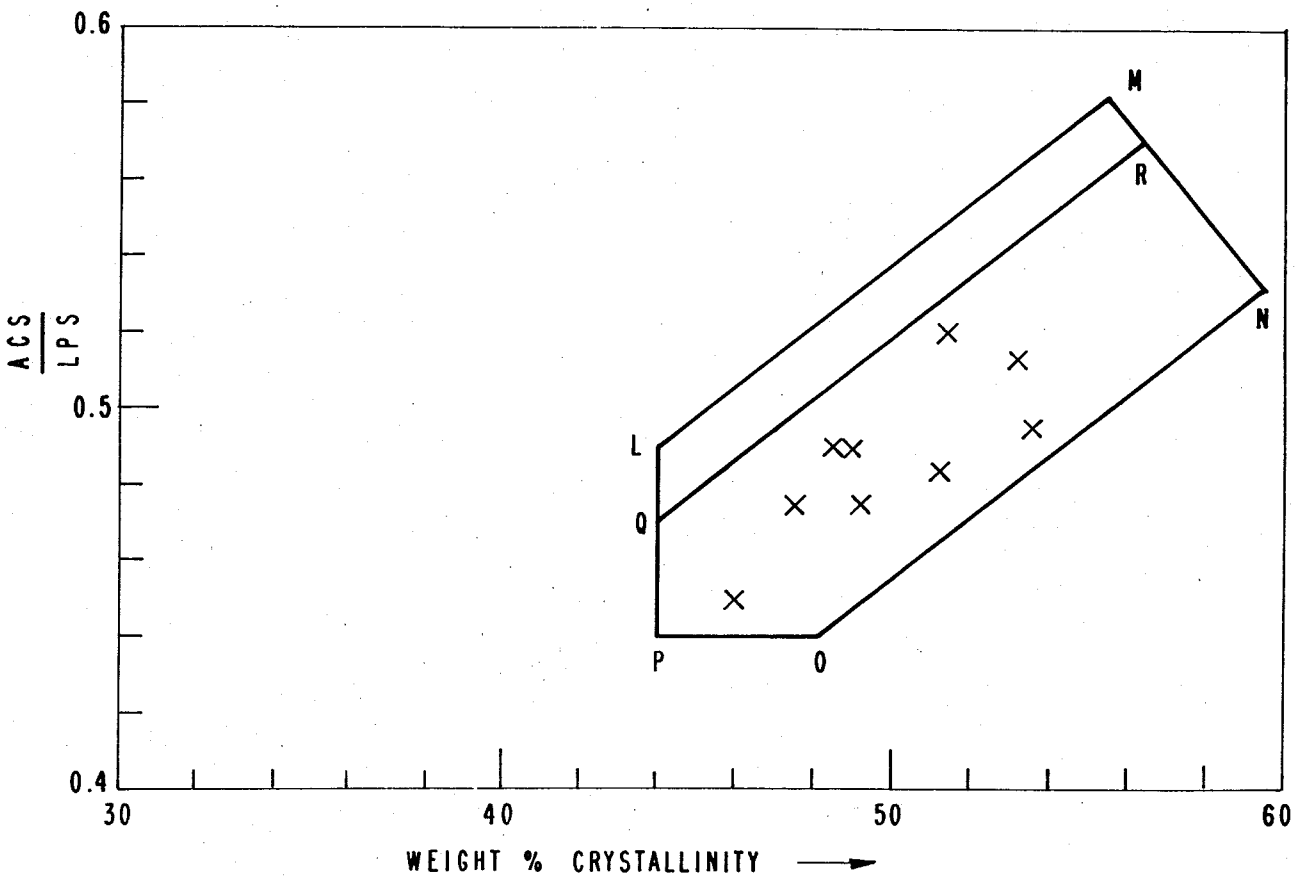

FIG. 3 shows relationships between the ratio of CS to LPS, and weight % crystallinity calculated from density for items containing 1% or less DEG (Tables 1, 2, 7, 9). Best filaments fall within the area LMNOP.

It is hypothesized that steam anneal fibers of the invention have an unusually high amorphous free volume (which favors dye rate) while also having good tensile properties and low residual shrinkage. It is believed that the parameters in FIGS. 2–4 reflect this good balance of fine structure properties.

EXAMPLE 9

This Example illustrates in Table 11 novel properties and fine structure of filaments of copolymers containing more than 3% by weight of WMOD.

The spun supply of Example 3 was used to prepare Item 1. A representative crimped sample had a melting point of 242° C.

Polyethylene terephthalate containing 2.4% ethylene sodium sulfoisophthalate (1.9% sodium sulfoisophthaloyl radicals), 1.7% DEG and 0.2% $TiO_2$ used to prepare filaments of 17 RV for Items 2, 3 and 4. A representative sample of crimped tow had a melting point of 249.4° C. Item 5 was prepared from the spun supply of Item 1-1 of Example 2. A representative sample of crimped tow had a melting point of 247° C.

Polyethylene terephthalate of about 22 RV containing 4.6% polyethylene oxide of 600 molecular weight, 0.7% DEG and 0.2% $TiO_2$ was spun at 1900 ypm (1737 meters/min) to give filaments which were drawn, annealed and crimped at several draw ratios and annealer restrictions to give Items 6 to 9. A representative sample of crimped tow melted at 251.9° C.

Filaments from the terpolymer spun supply of Example 4 were single-stage drawn, annealed and crimped at several draw ratios, annealer retractions and annealer steam pressures to give the fine structure parameters in Table 12. A representative sample melted at 246.5° C. Table 12, Item 5 is the same as the steam annealed product of Example 4.

In all these samples, the DEG was formed in the polymerization reaction. None was added.

Figure 4:
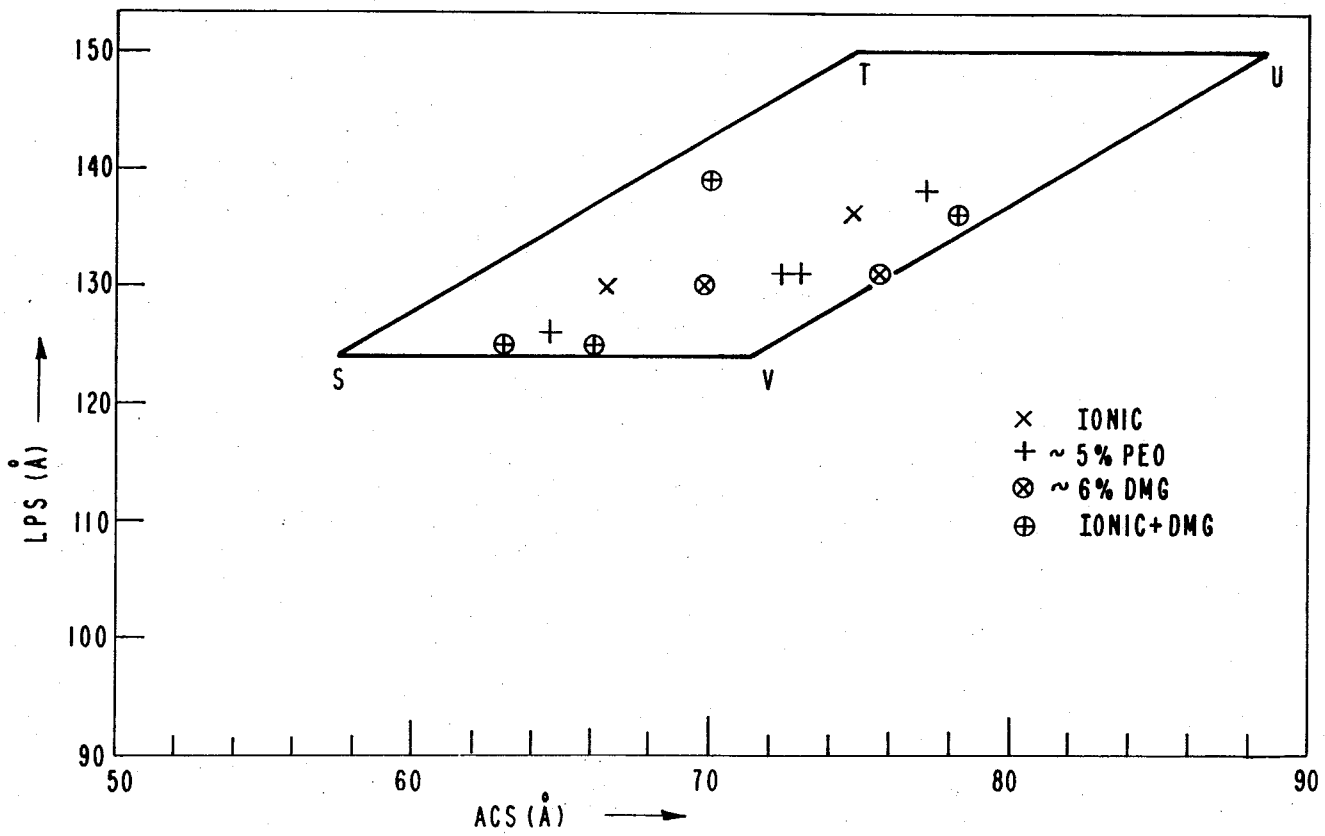

The relationship between LPS and ACS for the items of Examples 3, 4, 7 and 9 is shown in FIG. 4. Items of the invention fall in the area STUV. The criticality of these parameters is evident from the Tables. Items within the area have excellent dye rate/orientation balance and low residual shrinkage.

The criticality of steam pressure is clearly shown by comparison of Table 12, Items 1 and 2 which were made with comparable draw ratios. Item 2 shows very significant improvements in dye rate/orientation balance as shown by "D" number and in shrinkage. Table 12, Item 3 exemplifies an "overdrawn" filament made at a 1% annealer retraction. Annealer retractions of about 3% or more are particularly desirable for copolymers.

The LPS coordinates of the area HIJK in FIG. 2 and STUV in FIG. 4 are similar (125 to 150 Å and 124 to 150 Å respectively) but the ACS coordinates for filaments with WMOD 3% are shifted by about 3.5 Å. Presence of comonomer increases ACS significantly but changes LPS only slightly.

Table 11, Items 1 and 3 exemplify unexplained inconsistencies; probably normal experimental error. The properties of Item 1 are self-consistent; the LPS/ACS fall out of the preferred area in FIG. 4 and the dry heat shrinkage is unacceptably high. However, annealing steam pressure was in the preferred range and based on other samples, a fully acceptable filament was expected. It is believed that an error in the experiment was made, however, it is possible that some copolymers may require anneal pressures in excess of the 150 psig threshold to fully realize the advantages of the invention. Item 3 exemplifies a filament for which process conditions and properties are consistent, but with a single exception—in this case, the LPS is unexpectedly low.

Figure 5:
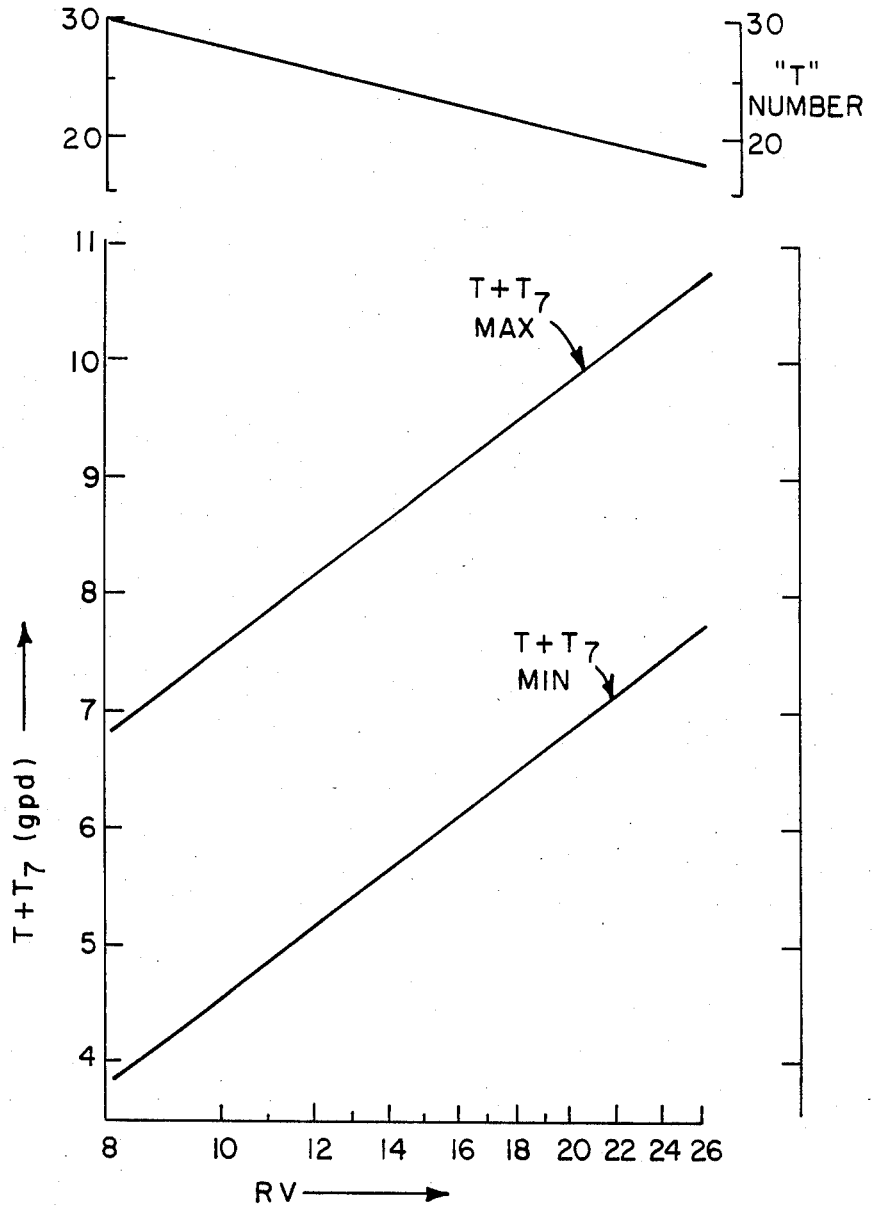
FIG. 5 shows graphs plotting tensile properties and surface trimer against relative viscosity.

All the above homopolyester filaments were of relative viscosity within the range 18–22, which is conventional for most apparel purposes. It is well known that use of lower viscosity polymer can provide polyester filaments of lower tensile properties, such as are generally undesirable for many textile purposes. These lower tensile properties are, however, accompanied by a lower flex life, giving a lower pilling tendency in the resulting fabrics. This can be very important, e.g. in certain knit fabrics, and so has sometimes outweighed any disadvantages of lower tensile properties. Accordingly, the tensile properties of the crimped filaments of the invention are affected by the relative viscosity of the polymer used. If lower viscosity polymer is used to make the polyester filaments, the tensile properties of the resulting steam-annealed crimped filaments can be expected to be correspondingly lower than for otherwise similar filaments of conventional viscosity. Thus, for uses when a low pilling tendency is important, a preferred group of filaments is of poly(ethylene terephthalate) having at least 93% dioxyethylene and terephthaloyl radicals, and especially at least 97% of such radicals, and having a relative viscosity of from about 9 to about 14, with a $T_7$ of greater than about 1.1 gpd, preferably greater than 1.2 gpd, a $T+T_7$ of greater than about 5 gpd and less than about 8 gpd, a dry heat shrinkage (196° C.) of less than about 10%, a "D" number of less than about 3.8 and greater than about 1.8, and a trimer "T" numbers of less than about 25. As indicated, the surface trimer content can generally be expected to be higher than for filaments of conventional viscosity. Such dependence on the relative viscosity of the tensile properties ($T+T_7$) and of the surface trimer content ("T" number) is represented graphically as in FIG. 5. These relationships can also be represented mathematically, e.g.

$$3.31 \geqq 3.31 \ln (RV) - (T+T_7) \geqq 0.1$$

Because steam-annealing according to the invention provides crimped annealed filaments having an improved balance of properties, this provides a way to improve somewhat the tensile strength of low molecular weight polymers, while improving the dyeability, and also providing filaments of lower flex resistance, i.e. improved pill-resistance, as shown in the following Example.

EXAMPLE 10

Filaments of poly(ethylene terephthalate)-homopolymer (0.7% DEG, and 0.3% $TiO_2$ with 0.2% tetraethyl silicate added to improve melt viscosity as taught by U.S. Pat. No. 3,335,211 to Mead and Reese) of about 12 RV having 3.8 dpf were spun at 1810 ypm (1655 meters/min) and collected. A combined bundle of 33,400 filaments was drawn in a single stage in the spray zone, but otherwise treated essentially as described in Example 1.

Process conditions and properties of filaments annealed without steam, for comparative purposes, and with steam at the indicated pressures are given in Table 13. The significant improvement achieved by steam-annealing can be noted in the tensile properties, shrinkage and dye rate, as well as reduced flex life, indicating better pill-resistance.

In the following Tables, polymer compositions, filament tenacity T, $T_7$ and $T+T_7$ were rounded off to one decimal place in the Tables. Small discrepancies (e.g., 0.1 units) between a sum and its components is explained by this rounding off versus calculations from the actual values determined. This applies also to values for machine draw ratio, underdrive in annealing and total draw ratio.

TABLE 1

| Item No. | 1 | 2 | 3 | 6 | 7 | 8 |
|---|---|---|---|---|---|---|
| MDR | 2.92 | 2.92 | 2.92 | 2.91 | 3.04 | 2.76 |
| PRUD | 0.99 | 0.99 | 0.99 | 0.99 | 0.96 | 0.93 |
| TDR | 2.89 | 2.89 | 2.89 | 2.88 | 2.93 | 2.58 |
| Anneal Process | None | None | None | Steam | Steam | Steam |
| Anneal Press. | | | | | | |
| psig | — | — | — | 200 | 200 | 200 |
| kPa | — | — | — | 1480 | 1480 | 1480 |
| Anneal Temp. (°C.) | — | — | — | 198 | 198 | 198 |
| Drier Temp. (°C.) | 90 | 125 | 135 | 90 | 90 | 90 |
| Fiber Properties | | | | | | |
| DPF | 1.55 | 1.65 | 1.68 | 1.45 | 1.43 | 1.57 |
| T (gpd) | 5.1 | 5.2 | 5.0 | 6.7 | 6.5 | 6.0 |
| $T_7$ (gpd) | 2.0 | 1.2 | 1.2 | 3.7 | 3.4 | 2.5 |
| Elongation (%) | 24 | 28 | 33 | 19 | 14 | 26 |
| $T + T_7$ (gpd) | 7.1 | 6.4 | 6.2 | 10.4 | 9.9 | 8.5 |
| BOS (%) | 7.4 | 0.9 | 0.5 | 2.2 | 1.6 | 1.5 |
| DHS (196° C.) (%) | 14 | 7 | 5 | 8 | 7 | 5 |
| Density (g/cc) | 1.368 | 1.385 | 1.384 | 1.392 | 1.393 | 1.396 |
| RDDR | 0.052 | 0.046 | 0.034 | 0.043 | 0.042 | 0.062 |
| Crimp Index | 32 | 30 | 28 | 27.5 | 29 | 20 |
| SCT (ppm) | 0 | 60 | 200 | 52 | 116 | 55 |
| Cryst. Index | 20 | — | 49 | — | 75 | — |
| ACS (Å) | 49 | — | 54 | — | 68 | — |
| LPS (Å) | — | — | 100 | — | 138 | — |
| "D" Number | 3.6 | 4.4 | 6.2 | 3.3 | 3.5 | 2.6 |
| "T" Number | <1 | 17 | 58 | 7 | 16 | 10 |

TABLE 2

| Item No. | 9 | 10 | 11 | 13 | | 15 |
|---|---|---|---|---|---|---|
| MDR | 2.91 | 2.90 | 2.91 | 2.83 | 2.87 | 2.82 |
| PRUD | 0.99 | 0.99 | 0.99 | 0.97 | 0.97 | 0.96 |
| TDR | 2.88 | 2.88 | 2.88 | 2.74 | 2.77 | 2.71 |
| Anneal Press. | | | | | | |
| psig | 50 | 95 | 150 | 100 | 115 | 200 |
| kPa | 440 | 760 | 1130 | 790 | 890 | 1480 |
| Anneal Temp. (°C.) | 148 | 168 | 185 | 170 | 175 | 198 |
| Fiber Properties | | | | | | |
| DPF | 1.52 | 1.50 | 1.49 | 1.56 | 1.51 | 1.57 |
| T (gpd) | 5.7 | 6.2 | 6.2 | 6.0 | 6.0 | 5.9 |
| $T_7$ (gpd) | 2.3 | 3.4 | 3.1 | 3.4 | 3.9 | 2.9 |
| Elongation (%) | 21 | 21 | 19 | 19 | 18 | 19 |
| $T + T_7$ (gpd) | 8.0 | 9.6 | 9.3 | 9.4 | 9.9 | 8.8 |
| BOS (%) | 2.4 | 3.1 | 1.3 | 1.8 | 4.1 | 1.7 |
| DHS (196° C.) (%) | 11 | 11 | 7 | 9 | 12 | 6 |
| Density (g/cc) | 1.37 | 1.386 | 1.390 | 1.389 | 1.380 | 1.396 |
| RDDR | 0.049 | 0.042 | 0.046 | 0.050 | 0.045 | 0.054 |
| Crimp Index | 37 | 31 | 30 | 32 | 17 | 31 |
| SCT (ppm) | 1 | 11 | 47 | 52 | 73 | 56 |
| Cryst. Index (%) | 31 | 45 | 60 | — | 54 | — |
| ACS (Å) | 53 | 51 | 57 | — | 58 | — |
| LPS (Å) | 95 | 95 | 127 | — | 115 | — |
| "D" Number | 3.5 | 3.6 | 3.4 | 3.1 | 3.3 | 3.0 |
| "T" Number | <1 | 2 | 7 | 8 | 10 | 10 |

All items steam-annealed, and then dried at 90° C.

TABLE 3

| Item No. | 1-1 | 1-4 | 1-5 | 1-6 | 1-7 | 1-8 |
|---|---|---|---|---|---|---|
| Anneal Process | None | Steam | Steam | Steam | Steam | Steam |
| Polymer Composition, % Modifier | | | | | | |
| $NaSO_3$-I* | 3.0 | 3.0 | 3.0 | 3.0 | 1.8 | 1.8 |
| DEG | 2.2 | 2.2 | 2.2 | 2.2 | 1.7 | 1.7 |
| WMOD | 4.5 | 4.5 | 4.5 | 4.5 | 3.1 | 3.1 |
| Process Conditions | | | | | | |
| MDR | 2.18 | 2.28 | 2.27 | 2.36 | 2.18 | 2.11 |
| PRUD | 0.99 | 0.96 | 0.94 | 0.88 | 0.97 | 0.90 |
| TDR | 2.17 | 2.18 | 2.14 | 2.07 | 2.11 | 1.89 |
| Anneal Press. | | | | | | |
| psig | — | 95 | 195 | 210 | 170 | 190 |
| kPa | — | 760 | 1440 | 1550 | 1270 | 1410 |
| Anneal Temp. (°C.) | — | 168 | 197 | 200 | 191 | 196 |
| Drier Temp. (°C.) | 140 | 90 | 90 | 90 | 90 | 90 |
| Fiber Properties | | | | | | |
| RV | 17 | 17 | 17 | 17 | 18 | 18 |
| DPF | 1.79 | 1.60 | 1.58 | 1.62 | 1.71 | 1.77 |
| Tenacity (gpd) | 3.9 | 4.4 | 4.3 | 4.2 | 4.2 | 3.8 |
| $T_7$ (gpd) | 1.0 | 1.9 | 2.2 | 1.1 | 2.2 | 1.1 |
| Elongation (%) | 33 | 17 | 18 | 20 | 24 | 29 |
| Crimp Index | 36 | 27 | 31 | 28 | 34 | 20 |
| DHS (196° C.) | 5 | 8 | 4 | 3 | 7 | 1.5 |
| Density (g/cc) | 1.391 | 1.386 | 1.395 | 1.400 | 1.39 | 1.396 |
| SCT (ppm) | — | — | 0 | 0 | — | 0 |
| RDDR | 0.14 | 0.14 | 0.17 | 0.22 | 0.11 | 0.19 |
| $T + T_7$ (gpd) | 4.9 | 6.3 | 6.5 | 5.2 | 6.4 | 4.9 |
| "D" Number | 5.2 | 4.0 | 3.2 | 3.0 | 3.6 | 2.6 |
| "T" Number | — | — | <1 | <1 | — | <1 |

*5-sodium-sulfoisophthalate

TABLE 4

| Item No. | 2-1 | 2-4 | 2-6 | 2-7 | 2-8 |
|---|---|---|---|---|---|
| Anneal Process | None | Steam | Steam | Steam | Steam |
| Polymer Composition, % Modifier | | | | | |
| DEG | 0.7 | 0.7 | 0.7 | 0.7 | 0.7 |
| DMG | 5.7 | 5.7 | 5.7 | 5.7 | 5.7 |
| WMOD | 4.2 | 4.2 | 4.2 | 4.2 | 4.2 |
| Process Conditions | | | | | |
| MDR | 2.39 | 2.39 | 2.59 | 2.31 | 2.49 |
| PRD | 0.98 | 0.97 | 0.90 | 0.90 | 0.94 |
| TDR | 2.34 | 2.32 | 2.33 | 2.08 | 2.34 |
| Anneal Press. | | | | | |
| psig | — | 95 | 190 | 185 | 195 |
| kPa | — | 760 | 1410 | 1380 | 1440 |
| Anneal (°C.) | — | 168 | 196 | 194 | 197 |
| Drier Temp. (°C.) | 140 | 90 | 90 | 90 | 90 |
| Fiber Properties | | | | | |
| DPF | 1.78 | 1.51 | 1.47 | 1.66 | 1.44 |
| Tenacity (gpd) | 3.5 | 3.9 | 4.1 | 3.6 | 4.7 |
| $T_7$ (gpd) | 0.9 | 2.0 | 1.1 | 1.0 | 1.6 |
| Elongation (%) | 49 | 39 | 26 | 37 | 28 |
| Crimp Index | 35 | 26 | 24 | 21 | 26 |
| DHS (196° C.) | 7 | 12 | 6 | 6 | 6 |
| Density (g/cc) | 1.384 | 1.387 | 1.396 | 1.391 | 1.39 |
| SCT (ppm) | — | — | 35 | 28 | 30 |
| RDDR | 0.15 | 0.16 | 0.22 | 0.26 | 0.21 |
| $T + T_7$ (gpd) | 4.5 | 5.9 | 5.2 | 4.6 | 6.2 |
| Cryst. Index (%) | — | 70 | 81 | — | 76 |
| ACS (Å) | — | 75 | 76 | — | 70 |
| LPS (Å) | — | 111 | 131 | — | 130 |
| "D" Number | 4.8 | 3.6 | 2.9 | 2.7 | 2.5 |
| "T" Number | — | — | 12 | 11 | 9 |

TABLE 5

| Composition % | Steam | (T-64) |
|---|---|---|
| $NaSO_3$-I | 1.6 | (2.8)* |
| DMG | 2.35 | — |
| DEG | 1.33 | (1.9) |
| WMOD | 4.0 | (4.1) |
| Fiber Properties | | |
| DPF | 2.35 | 2.25 |
| T (gpd) | 3.9 | 3.4 |
| $T_7$ (gpd) | 1.2 | 1.1 |
| Elongation (%) | 28 | 28 |
| DHS (196° C.) (%) | 3 | ca 5 |
| $T + T_7$ (gpd) | 5.2 | 4.5 |
| RDDR | 0.24 | 0.11 |
| D Number | 2.5 | (6.2) |
| % Dye Bath Exhaust 60 Min. at Boil: | | |
| Disperse Dye | 95 | 90 |
| Cationic Dye | 82 | 66 |
| Yarn strength (GM) | 440 | 410 |
| Yarn DHS (196° C.) (%) | 2 | 5 |

*Based on nominal composition

TABLE 6

| Sample | 3-1 | 3-3 | 3-4 | 3-6 |
|---|---|---|---|---|
| Anneal Process | None | Steam | None | Steam |
| Polymer Compositlon | | | | |
| $NaSO_3$-I | 0 | 0 | 1.6 | 1.6 |
| DEG | 2.4 | 2.4 | 1.3 | 1.3 |
| DMG | 0 | 0 | 2.35 | 2.35 |
| WMOD | 2.35 | 2.35 | 4.0 | 4.0 |
| Process Conditions | | | | |
| MDR | 3.19 | 3.06 | 2.94 | 2.94 |
| PRUD | 0.98 | 0.94 | 0.96 | 0.96 |
| TDR | 3.14 | 2.88 | 2.82 | 2.82 |

TABLE 6-continued

| Sample | 3-1 | 3-3 | 3-4 | 3-6 |
|---|---|---|---|---|
| Anneal Pres. | | | | |
| psig | — | 195 | — | 150 |
| kPa | — | 1440 | — | 1130 |
| Anneal (°C.) | — | 197 | — | 189 |
| Drier Temp. (°C.) | 130 | 90 | 135 | 80 |
| Fiber Properties | | | | |
| RV | 20 | 20 | 17 | 17 |
| DPF | 1.61 | 1.47 | 2.42 | 2.18 |
| T (gpd) | 5.4 | 6.6 | 4.2 | 4.7 |
| $T_7$ (gpd) | 1.2 | 2.9 | 1.1 | 2.1 |
| Elongation (%) | 31 | 19 | 34 | 22 |
| Crimp Index | — | 28 | 19 | 31 |
| DHS (196° C.) (%) | 7 | 6 | 7 | 7 |
| Density (g/cc) | — | 1.394 | 1.388 | 1.396 |
| SCT (ppm) | — | 46 | — | — |
| RDDR | 0.054 | 0.075 | 0.10 | 0.14 |
| T + $T_7$ (gpd) | 6.6 | 9.4 | 5.3 | 6.8 |
| "D" Number | 5.9 | 3.3 | 5.7 | 3.3 |
| "T" Number | — | 7 | — | — |

TABLE 7

| Item | M | D | R |
|---|---|---|---|
| MDR | 2.52 | 2.52 | 2.52 |
| PRUD | 0.99 | 0.97 | 0.93 |
| TDR | 2.50 | 2.45 | 2.34 |
| Anneal Press. | | | |
| psig | 200 | 200 | 200 |
| kPa | 1480 | 1480 | 1480 |
| Anneal Temp. (°C.) | 198 | 198 | 198 |
| DPF | 1.39 | 1.40 | 1.43 |
| T (gpd) | 5.3 | 5.7 | 5.6 |
| $T_7$ (gpd) | 2.8 | 3.0 | 2.0 |
| Elongation (%) | 19 | 19 | 22 |
| BOS (%) | 3 | 2 | 2 |
| DHS (196° C.) (%) | 7 | 6 | 3 |
| Crimp Index | 31 | 27 | 28 |
| Density (g/cc) | 1.386 | 1.392 | 1.398 |
| RDDR | 0.050 | 0.049 | 0.065 |
| SCT (ppm) | 40 | 35 | 25 |
| T + $T_7$ | 8.1 | 8.7 | 7.6 |
| "D" Number | 3.7 | 3.6 | 3.0 |
| "T" Number | 8 | 6 | 5 |
| Cryst. Index (%) | 76 | 72 | 73 |
| ACS (Å) | 68 | 64 | 69 |
| LPS (Å) | 120 | 131 | 134 |

TABLE 8

| Item Code | E | EE | I |
|---|---|---|---|
| Polymer Composition, %: | | | |
| DEG | 1.0 | 0.7 | 0.7 |
| PEO-600 | 2.1 | 4.6 | 4.6 |
| WMOD | 3.0 | 5.2 | 5.2 |
| Process Conditions | | | |
| MDR | 2.40 | 2.41 | 2.41 |
| PRUD | 0.93 | 0.93 | 0.98 |
| TDR | 2.24 | 2.25 | 2.37 |
| Fiber Properties | | | |
| DPF | 1.55 | 1.56 | 1.54 |
| Tenacity (gpd) | 5.7 | 5.2 | 5.3 |
| $T_7$ (gpd) | 2.3 | 1.5 | 1.7 |
| Elongation (%) | 24 | 27 | 23 |
| Crimp Index | 28 | 29 | 30 |
| DHS (196° C.) (%) | ca 3 | 5 | 9 |
| Density | 1.388 | 1.390 | 1.389 |
| SCT (ppm) | 24 | 17 | 65 |
| RDDR | 0.12 | 0.22 | 0.20 |
| T + $T_7$ (gpd) | 7.9 | 6.7 | 7.0 |
| "D" Number | 2.6 | 2.9 | 3.1 |
| "T" Number | 5 | 5 | 16 |
| Cryst. Index (%) | 72 | 80 | 72 |
| ACS (Å) | 66 | 73 | 66 |
| LPS (Å) | 132 | 131 | 122 |

All items were steam-annealed at 200 psig (1480 kPa), and then dried at 90° C.

TABLE 9

| Item | 1 | 2 | 3 | 4 | 5 | 6 |
|---|---|---|---|---|---|---|
| Anneal Press. | | | | | | |
| psig | 205 | 195 | 200 | 205 | 210 | 110 |
| kPa | 1510 | 1440 | 1480 | 1510 | 1550 | 860 |
| Anneal Temp. (°C.) | 199 | 197 | 198 | 199 | 202 | 173 |
| $T_7$ (gpd) | 2.9 | 2.8 | 2.3 | 2.0 | 1.7 | 2.9 |
| T + $T_7$ (gpd) | 8.5 | 9.1 | 9.1 | 8.0 | 7.4 | 9.3 |
| DHS (196° C.) (%) | 6 | 6 | 5 | 3 | 3 | 10 |
| "D" Number | 2.9 | 2.9 | 3.0 | 2.7 | 2.1 | 3.3 |
| "T" Number | 11 | 13 | 11 | 8 | 6 | 12 |
| Density (g/cc)* | 1.3942 | 1.3921 | 1.3965 | 1.3968 | 1.3995 | 1.3876 |
| Cryst. Index (%) | 70 | 72 | 73 | 77 | 79 | 63 |
| ACS (Å) | 66.5 | 64 | 67 | 71 | 74 | 59 |
| LPS (Å) | 140 | 134 | 138 | 137 | 146 | 118 |

TABLE 10

| Item | 1 | 2 | 3 | 4 | 5 |
|---|---|---|---|---|---|
| Comonomer | DEG | DEG | PEO | PEO | PEO |
| WMOD (%) | 2.35 | 2.35 | 3.0 | 3.0 | 3.0 |
| Anneal Pres. | | | | | |
| psig | 200 | 200 | 200 | 200 | 160 |
| kpa | 1480 | 1480 | 1480 | 1480 | 1200 |
| Anneal Temp. | 198 | 198 | 198 | 198 | 188 |
| $T_7$ (gpd) | 2.6 | 2.6 | 2.3 | 2.2 | 2.3 |
| T + $T_7$ (gpd) | 8.3 | 9.2 | 7.9 | 7.4 | 7.6 |
| DHS (196° C.) | 9 | 7 | ca 3 | 4 | 8 |
| "D" Number | 3.7 | 4.3 | 2.6 | 2.7 | 2.9 |
| "T" Number | <13* | 12 | 5 | 8 | — |
| Density (g/cc) | 1.387 | 1.388 | 1.388 | 1.388 | 1.377 |
| Cryst. Index (%) | 75 | 73 | 72 | 67 | 63 |
| ACS (Å) | 70 | 69 | 66 | 63 | 61 |
| LPS (Å) | 136 | 132 | 132 | 132 | 126 |

| Item | 6 | 7 | 8 | 9 |
|---|---|---|---|---|
| Comonomer | PEO | DMG | DMG | DMG |
| WMOD (%) | 3.0 | 2.9 | 2.9 | 2.9 |
| Anneal Pres. | | | | |
| psig | 160 | 100 | 140 | 160 |
| kPa | 1200 | 790 | 1070 | 1200 |
| Anneal Temp. | 188 | 170 | 183 | 188 |
| $T_7$ (gpd) | 2.5 | 1.8 | 2.6 | 2.2 |
| T + $T_7$ (gpd) | 8.0 | 6.8 | 7.9 | 7.1 |
| DHS (196° C.) | 8 | 12 | 10 | 6 |
| "D" Number | 2.9 | 4.1 | 3.4 | 3.6 |
| "T" Number | 3 | 4 | — | — |
| Density (g/cc) | 1.388 | 1.384 | 1.385 | 1.392 |
| Cryst. Index (%) | 70 | 65 | 76 | 68 |
| ACS (Å) | 65 | 58 | 67 | 62 |
| LPS (Å) | 127 | 114 | 115 | 126 |

*Estimated

TABLE 11

| Item | 1 | 2 | 3 | 4 | 5 |
|---|---|---|---|---|---|
| Comonomer | DMG | $NaSO_3I$ | $NaSo_3I$ | $NaSO_3I$ | $NaSO_3I$ |
| WMOD (%) | 4.2 | 3.6 | 3.6 | 3.6 | 4.5 |
| Anneal Pres. | | | | | |
| psig | 165 | 100 | 165 | 195 | 195 |
| kPa | 1240 | 790 | 1240 | 1440 | 1440 |
| Anneal Temp. (°C.) | 189 | 170 | 189 | 197 | 197 |
| $T_7$ (gpd) | 2.0 | 1.0 | 2.1 | 1.9 | 1.5 |
| T + $T_7$ (gpd) | 6.3 | 4.9 | 6.4 | 6.5 | 5.4 |
| DHS (196° C.) (%) | 11 | 8 | 8 | 7 | 5 |
| "D" Number | 3.1 | 4.6 | 3.4 | 2.9 | 3.2 |
| "T" Number | — | — | — | <1 | <1 |
| Density (g/cc) | 1.386 | 1.390 | 1.394 | 1.396 | 1.401 |
| Cryst. Index (%) | 78 | 53 | 78 | 77 | 80 |
| ACS (Å) | 70 | 53 | 65 | 67 | 75 |

TABLE 11-continued

| LPS (Å) | 122 | 114 | 121 | 130 | 136 |
|---|---|---|---|---|---|
| Item | 6 | 7 | 8 | 9 | |
| Comonomer | PEO | PEO | PEO | PEO | |
| WMOD (%) | 5.2 | 5.2 | 5.2 | 5.2 | |
| Anneal Pres. | | | | | |
| psig | 160 | 200 | 200 | 180 | |
| kPa | 1200 | 1480 | 1480 | 1340 | |
| Anneal Temp. (°C.) | 188 | 197 | 197 | 193 | |
| $T_7$ (gpd) | 1.2 | 1.4 | 1.5 | 1.6 | |
| $T + T_7$ (gpd) | 5.7 | 6.3 | 6.7 | 6.7 | |
| DHS (196° C.) (%) | 4 | 3 | 5 | 8 | |
| "D" Number | 2.7 | 2.5 | 2.9 | 3.1 | |
| "T" Number | 8 | 2 | 4 | 6 | |
| Density (g/cc) | 1.384 | 1.389 | 1.390 | 1.389 | |
| Cryst. Index (%) | 79 | 83 | 80 | 71 | |
| ACS (Å) | 72 | 77 | 73 | 65 | |
| LPS (Å) | 131 | 138 | 131 | 126 | |

TABLE 12

| Item | 1 | 2 | 3 | 4 | 5 | 6 |
|---|---|---|---|---|---|---|
| Anneal Press. | | | | | | |
| psig | 100 | 150 | 150 | 200 | 200 | 190 |
| kPa | 790 | 1130 | 1130 | 1480 | 1480 | 1410 |
| Anneal Temp. (°C.) | 170 | 186 | 186 | 198 | 198 | 196 |
| $T_7$ (gpd) | 1.9 | 1.9 | 2.0 | 1.6 | 1.2 | 1.2 |
| $T + T_7$ (gpd) | 6.3 | 6.1 | 6.9 | 6.0 | 5.2 | 5.0 |
| DHS (196° C.) | 11 | 6 | 12 | 4 | 3 | 4 |
| "D" Number | 4.3 | 2.9 | 3.9 | 2.6 | 2.5 | 2.3 |
| "T" Number | 1 | — | — | 1 | 1 | 1 |
| Density (g/cc) | 1.389 | 1.395 | 1.3905 | 1.395 | 1.3975 | 1.3976 |
| Cryst. Index (%) | 70 | 74 | 71 | 64 | 82 | 69 |
| ACS (Å) | 64 | 66 | 63 | 62 | 78 | 70 |
| LPS (Å) | 117 | 125 | 125 | 137 | 136 | 139 |

TABLE 13

| Item No. | 1 | 2 | 3 |
|---|---|---|---|
| MDR | 3.08 | 3.08 | 3.09 |
| PRUD | 0.99 | 0.95 | 0.95 |
| TDR | 3.05 | 2.93 | 2.93 |
| Anneal Process | None | Steam | Steam |
| Steam Press. psig | — | 180 | 205 |
| Anneal Temp., (°C.) | — | 193 | 199 |
| Relax Temp., (°C.) | 110 | 80 | 80 |
| Fiber Properties | | | |
| DPF | 1.60 | 1.55 | 1.56 |
| T (gpd) | 3.4 | 4.5 | 4.2 |
| $T_7$ (gpd) | 1.7 | 2.5 | 2.5 |
| Elongation (%) | 32 | 18 | 21 |
| DHS (196° C.) | 7.5 | 3 | 3 |
| Density (g/cc) | 1.370 | 1.395 | 1.395 |
| RDDR | 0.056 | 0.075 | 0.088 |
| Crimp Index | 32 | 24 | 23 |
| SCT (ppm) | — | 49 | 86 |
| Cryst. Index (%) | 37 | 75 | 72 |
| ACS (Å) | 55 | 58 | 63 |
| LPS (Å) | 94 | 130 | 137 |
| "D" Number | 4.7 | 2.8 | 2.4 |
| "T" Number | — | 13 | 23 |
| Flex Life | 9611 | 5198 | 6324 |

What is claimed is:

1. A crimped filament of poly(ethylene terephthalate) having at least 93% by weight of dioxyethylene and terephthaloyl radicals repeating units and having an improved balance of dyeability and tensile properties which comprise a $T_7$ of at least 1.5 gpd, a $T+T_7$ of at least 7 gpd and less than about 10 gpd, wherein T is the tenacity at break elongation and $T_7$ is the tenacity at 7% elongation, a dry heat shrinkage at 196° C. of less than about 10%, a dyeability/orientation relationship characterized by a "D" number of less than about 3.8 and greater than about 1.8, a surface cyclic trimer content as defined by a "T" number of less than about 20, and a relative viscosity of less than 25.

2. A bundle of filaments of claim 1 having a crimp index of at least about 20.

3. A filament of claim 1 in which the polymer consists of at least 97% by weight of dioxyethylene and terephthaloyl radicals and any remaining radicals consist of organic radicals selected from the group consisting of dioxydiethylene ether, adipyl, glutaryl, and dioxy-poly(ethylene oxide) having a molecular weight of less than about 4000.

4. A filament of claim 1 having at least 97% dioxyethylene and terephthaloyl radicals and an X-ray crystalline fine structure characterized by a long period spacing/crystallite size relationship within the area HIJK of FIG. 2 herein and the polymer contains no more than 0.3% radicals containing ionic dye sites.

5. A filament of claim 4 substantially free of ionic dye sites.

6. A filament of claim 1 having at least 97% dioxyethylene and terephthaloyl radicals and wherein the apparent crystalline size/long period spacing ratio and weight percent crystallinity are within the area LMNOP of FIG. 3.

7. A filament of claim 6 having an apparent crystalline size/long period spacing ratio and weight percent crystallinity within the area NOPQR of FIG. 3.

8. A crimped filament of poly(ethylene terephthalate) comprised of at least 93% by weight of dioxyethylene and terephthaloyl radicals and no more than 0.3% radicals with ionic dye sites and containing at least 3% of other neutral radicals, the filament having an improved balance of dyeability and tensile properties comprising a $T_7$ of greater than 1.1 gpd, a $T+T_7$ of greater than 5 gpd and less than 7 gpd, wherein T is the tenacity at break elongation and $T_7$ is the tenacity at 7% elongation, a dry heat shrinkage at 196° C. of less than about 10%, a "D" number of less than 3.8 and greater than about 1.8, a trimer "T" number of less than about 20 and a RDDR dye rate of at least 0.12.

9. A filament of claim 8 in which the polymer is free of radicals containing an ionic dye site.

10. A filament of claim 9 wherein the other neutral radicals are selected from the group consisting of glutaryl, adipyl, dioxydiethylene ether, and dioxy-poly(ethylene oxide) having a molecular weight of less than 4000.

11. A filament of claim 10 having a long period spacing and apparent crystallite size within area STUV of FIG. 4.

12. A filament of claim 11 containing from about 3 to about 4% of glutaryl radicals and about 1% dioxyethylene ether radicals.

13. A filament of claim 12 having a relative viscosity within the range of 16 to 20.

14. A crimped filament of poly(ethylene terepthlate) comprised of at least 93% by weight of dioxyethylene and terephthaloyl radicals, at least 1.3% of aromatic radicals containing an ionic dye site and up to about 4% of neutral organic radicals, the filament having an improved balance of dyeability and tensile properties comprising a $T_7$ of greater than 1.2 gpd, a $T+T_7$ greater than about 5.0 gpd and less than 7.0 gpd, wherein T is the tenacity at break elongation and $T_7$ is the tenacity at 7% elongation, a dry heat shrinkage at 196° C. of less than about 10%, a "D" number of less than about 3.8 and greater than about 1.8 and a trimer "T" number of less than about 20.

15. A filament of claim 14 wherein the long period spacing and apparent crystalline size are within the area STUV of FIG. 4.

16. A filament of claim 15 wherein the radicals containing an ionic dye site are 5-sodium sulfonate isophthaloyl radicals.

* * * * *